US006160254A

United States Patent [19]

Zimmerman et al.

[11] Patent Number: 6,160,254

[45] Date of Patent: Dec. 12, 2000

[54] DEVICES AND METHODS FOR INDICATING LOSS OF SHOCK ABSORPTION IN A SHOE

[76] Inventors: Michael J. Zimmerman, 12 E. 86th St., Apt. 1423, New York, N.Y. 10028; J. Bryan Boatner, 99A Prince St., Apt. 1, Boston, Mass. 02113

[21] Appl. No.: 09/260,824

[22] Filed: Mar. 2, 1999

[51] Int. Cl.[7] ..... G02F 1/01

[52] U.S. Cl. ..... 250/225; 36/114

[58] Field of Search ..... 250/559.45, 559.4, 250/559.27, 225; 36/114, 119.1, 115; 73/172; 340/573

[56] References Cited

U.S. PATENT DOCUMENTS

| | | | |
|---|---|---|---|
| 3,966,326 | 6/1976 | Brull et al. | 356/114 |
| 5,914,659 | 6/1999 | Herman et al. | 340/573 |
| 5,918,502 | 7/1999 | Bishop | 73/172 |

OTHER PUBLICATIONS

"Tech Note—Introduction to Stress Analysis by the Photo-Stress Method," Measurements Group, Inc. 1989.

Joseph A. Burns and Judith Klein Burns; "Kinetic Art: A Mural of Variably Stressed Photoelastic Material with Light Polarizers;" *Leonardo*, vol. 6, pp. 325–327, 1973.

*Primary Examiner*—Hung Xuan Dang

*Attorney, Agent, or Firm*—Fish & Neave; Matthew T. Byrne

[57] ABSTRACT

The present invention is devices and methods for indicating, to a wearer of a shoe, a loss of shock absorption in the shoe so that the wearer can know that it is time to obtain new shoes and thereby avoid injury. The devices and methods of the present invention indicate a loss of shock absorption as follows. First, one or more sensors in the sole of the shoe detect the amount of force that is applied to the sensors while a wearer's body weight is pressing down on the shoe. Then, when a sufficient amount of force is detected by the sensors in the sole of the shoe, the sensors provide a warning to the wearer of the shoe that the shoe has lost its shock-absorbing capability.

13 Claims, 7 Drawing Sheets

DEVICES AND METHODS FOR INDICATING LOSS OF SHOCK ABSORPTION IN A SHOE

BACKGROUND OF THE INVENTION

The present invention relates to shoes that are worn on the human foot. More particularly, the present invention relates to shoes that are worn on the human foot and that provide shock absorption for a wearer.

Many shoes that are worn by people all over the world today are designed to provide some level of shock absorption for the wearer. Such shoes include running shoes, basketball shoes, tennis shoes, walking shoes, hiking shoes, certain dress shoes, etc. The shock absorption provided by these shoes not only provides a level of comfort to the wearer, but also provides protection to the wearer against injury resulting from impact of the wearer's foot on a floor or other hard surface.

A limitation of these types of shock-absorbing shoes is that they typically lose their shock-absorbing capability with normal use by a wearer. More particularly, as the shoes are worn by the wearer, shock-absorbing materials in the shoes' soles begin to become less resilient. Eventually, the loss of shock-absorbing capability in these shoes may result in an injury to the wearer when the wearer uses the shoes in a manner in which the full shock-absorbing capability of the shoes is required, such as running with running shoes for example.

A further limitation of these types of shock-absorbing shoes is that they fail to indicate to the wearer when the shock-absorbing capability of the shoes has fallen below a minimum acceptable level. Because of this limitation, the wearer may have no idea that the shoes that he or she is wearing are not providing the minimum level of shock absorption that the wearer desires. Consequently, the wearer may have to either first suffer an injury or guess that the shoes are worn out before deciding to obtain new shoes.

In view of the foregoing, it would be desirable to provide devices and methods for indicating, to a wearer of a shoe, a loss of shock absorption in the shoe so that the wearer can know that it is time to obtain new shoes and thereby avoid injury.

SUMMARY OF THE INVENTION

It is therefore an object of the present invention to provide devices and methods for indicating, to a wearer of a shoe, a loss of shock absorption in the shoe so that the wearer can know that it is time to obtain new shoes and thereby avoid injury.

In accordance with this and other objects of the invention, there are provided devices and methods for indicating, to a wearer of a shoe, a loss of shock absorption in the shoe so that the wearer can know that it is time to obtain new shoes and thereby avoid injury. The devices and methods of the present invention indicate a loss of shock absorption by incorporating one or more sensors in the sole of the shoe that detect and indicate the amount of force or stress that is applied to the sensors while a wearer's body weight is pressing down on the shoe. As shock absorbing material in the shoe wears out, force is shifted from the shock absorbing material to the sensors. When the amount of stress has increased beyond a certain point, the sensors provide a warning to the wearer of the shoe that the shoe has lost its shock-absorbing capability.

BRIEF DESCRIPTION OF THE DRAWINGS

The above and other objects and advantages of the present invention will be apparent upon consideration of the following detailed description, taken in conjunction with the accompanying drawings, in which like reference characters refer to like parts throughout, and in which.

DETAILED DESCRIPTION OF THE INVENTION

Figure 1:
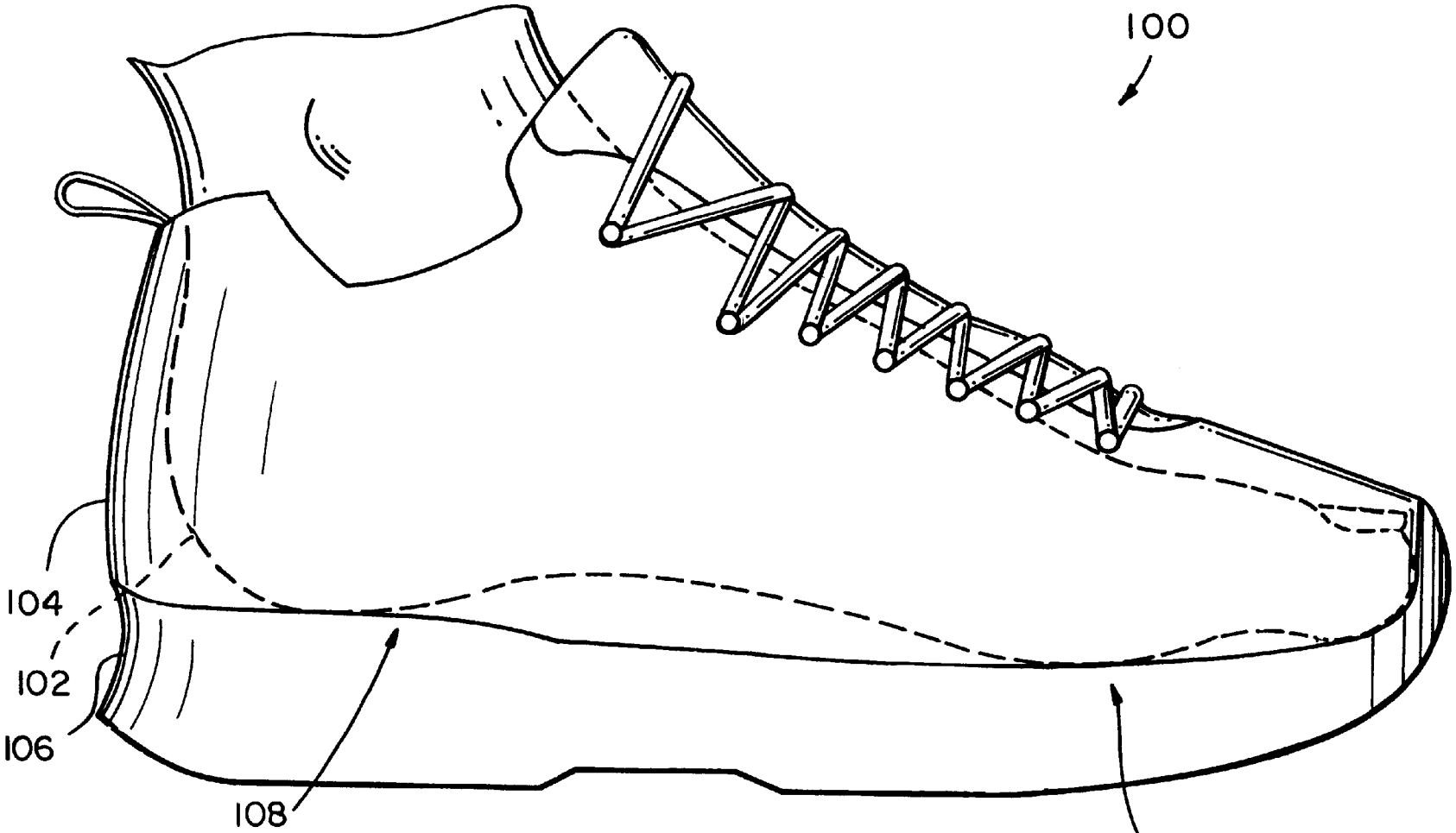
FIG. 1 (PRIOR ART)
FIG. 1 is a cross-sectional side view of a prior art running shoe.

FIG. 1 illustrates a known running shoe 100 as worn on a wearer's foot 102. As shown, shoe 100 includes an upper portion 104 and a sole 106. As is known in the art, upper portion 104 may be constructed of canvas, leather, or any other suitable material, and may incorporate padding, laces (as shown, or any other fastening mechanism), reflectors, and any other suitable structural or decorative components. As is also known in the art, sole 106 may be constructed of ethylene vinyl acetate (EVA), polyurethane, or any other suitable material or combination of materials, and may incorporate air pockets, gel pockets, pumps, flashing lights, etc.

As can be seen from FIG. 1, when wearer's foot 102 is in shoe 100, forces are primarily transferred from sole 106 of shoe 100 to foot 102 in regions 108 and 110. When the wearer is walking, running, or jumping, impact forces against wearer's foot 102 can be very large (for example, two to four times the wearer's body weight when running). Accordingly, regions 108 and 110 are usually designed so that sole 106 absorbs as much shock (or impact forces) as possible without sacrificing too much stability in shoe 100.

When sole 106 becomes worn out, however, this shock-absorbing capability of shoe 100 becomes lost, and wearer's foot 102 may become subjected to very large impact forces. These very large impact forces can cause injury to the wearer's foot and leg. Moreover, because shoe 100 provides no mechanism for determining when sole 106 has become worn out, the wearer must guess when sole 106 is worn out or wait until an injury is suffered.

Figure 2:
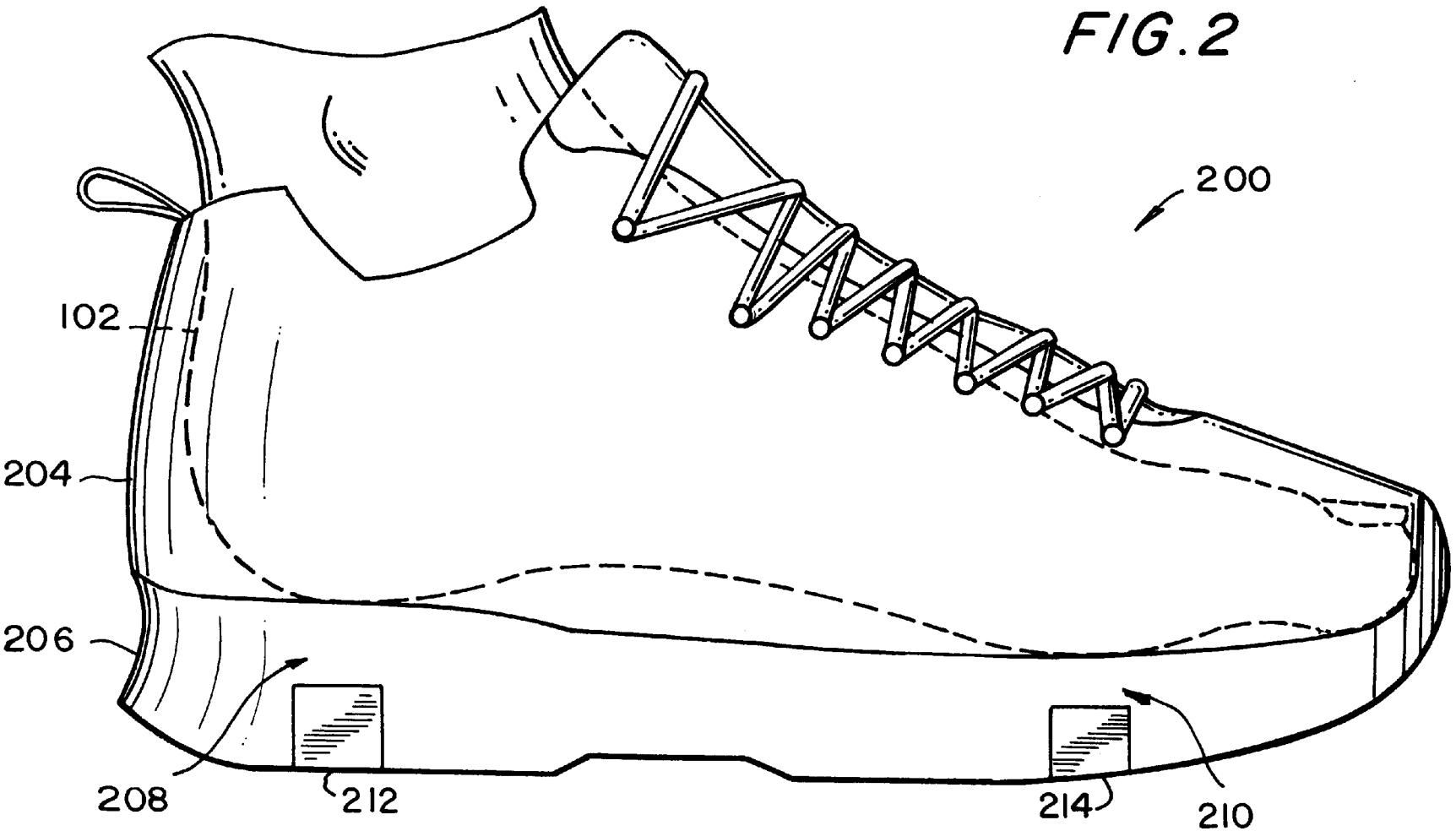
FIG. 2 is a cross-sectional side view of a running shoe constructed in accordance with the principles of the present invention.

The present invention provides a mechanism to determine when a shoe sole has become worn out. As shown in FIG. 2, a running shoe 200 in accordance with one embodiment of the present invention includes an upper portion 204, a sole 206, and sensors 212 and 214. Upper portion 204 is substantially the same as upper portion 104 that was explained in connection with FIG. 1. Aside from the incorporation of sensors 212 and 214 in sole 206, sole 206 is substantially the same as sole 106 that was explained in connection with FIG. 1. Sensors 212 and 214, on the other hand, are not found in shoe 100 of FIG. 1 and provide one type of shock-absorption-loss-indication mechanism of the present invention.

Preferably, each of sensors 212 and 214 incorporate a piece of a birefringent material (also known as a photo elastic material) and a pair of light polarizers. A birefringent material is a material that has a non-constant index of refraction (i.e., the ratio of the speed of light in a material to the speed of light in a vacuum) which changes with the amount of stress that is applied to the material. In addition, a birefringent material has the property of splitting incident white light into two components, which travel at right angles to each other and at different velocities. The amount by which these components of light differ in velocity depends on the amount of stress that the birefringent material is being subjected to. Because the two components of light travel at different velocities, light interference produces fringes in the birefringent material that are visible with the aid of the light polarizers. Depending on the specific material used, these fringes appear as fringe bands within the material at specified levels of stress upon the material. Between these fringe bands, the material also changes the color of light passing through the material as a function of the stress applied.

Preferably, the birefringent material in sensors 212 and 214 is a transparent polyurethane rubber called "PSM9," available from Vishay Measurements Group, Inc., Raleigh, N.C., although any suitable type of birefringent material could also be used. The light polarizers are preferably a pair of left and right hand circular polarizers ("LHCP" and "RHCP"), also available from Vishay Measurements Group, Inc., Raleigh, N.C., although any suitable light polarizers for use with birefringent materials could also be used. Further information on birefringent materials and light polarizers is discussed in Vishay Measurements Group, Inc., Vishay Measurements Group Tech Note TN-702-1 (1989), available from Vishay Measurements Group, Inc., Raleigh, N.C., which is hereby incorporated by reference herein in its entirety.

Figure 3:
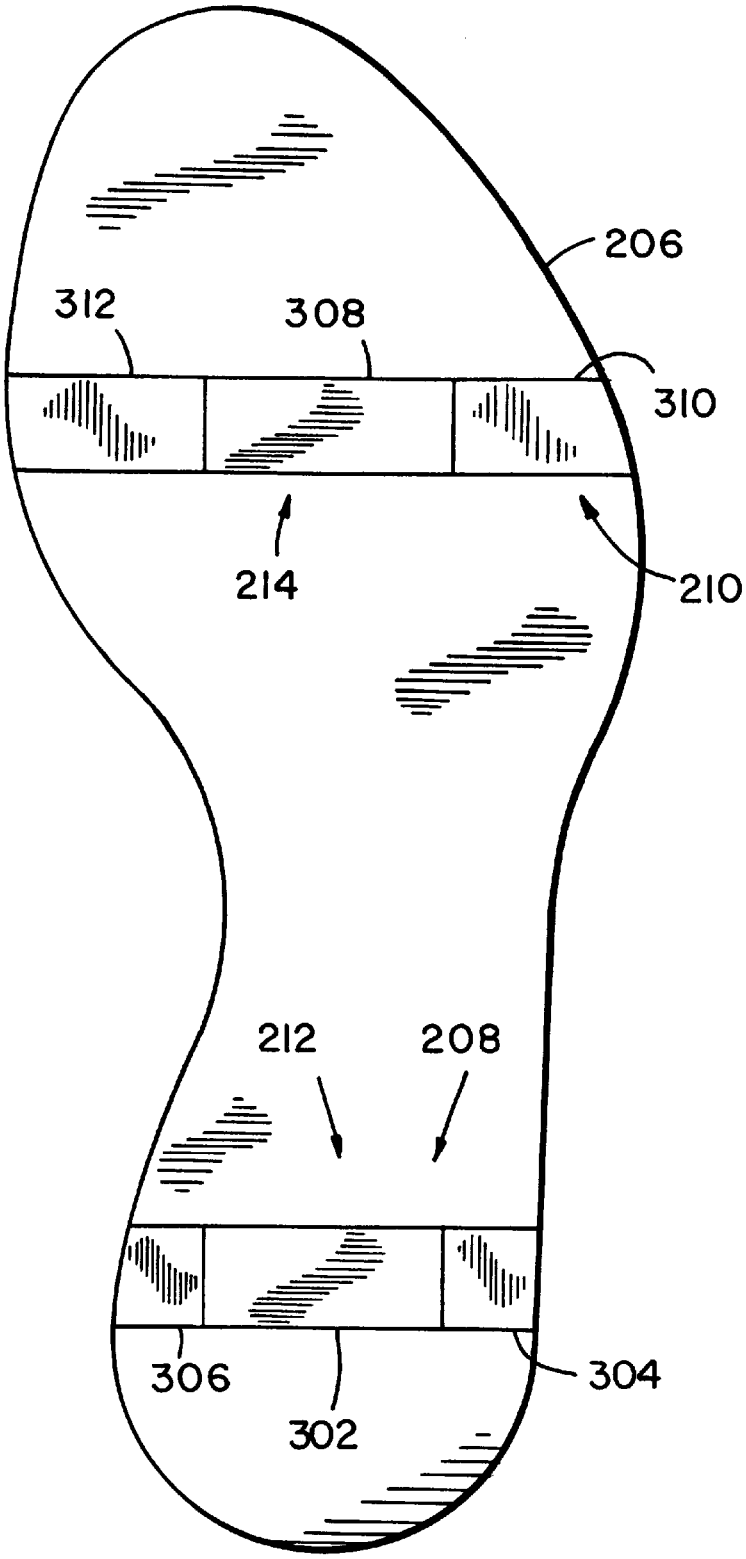
FIG. 3 is a cross-sectional bottom view of a running shoe constructed in accordance with the principles of the present invention.
Figure 4:
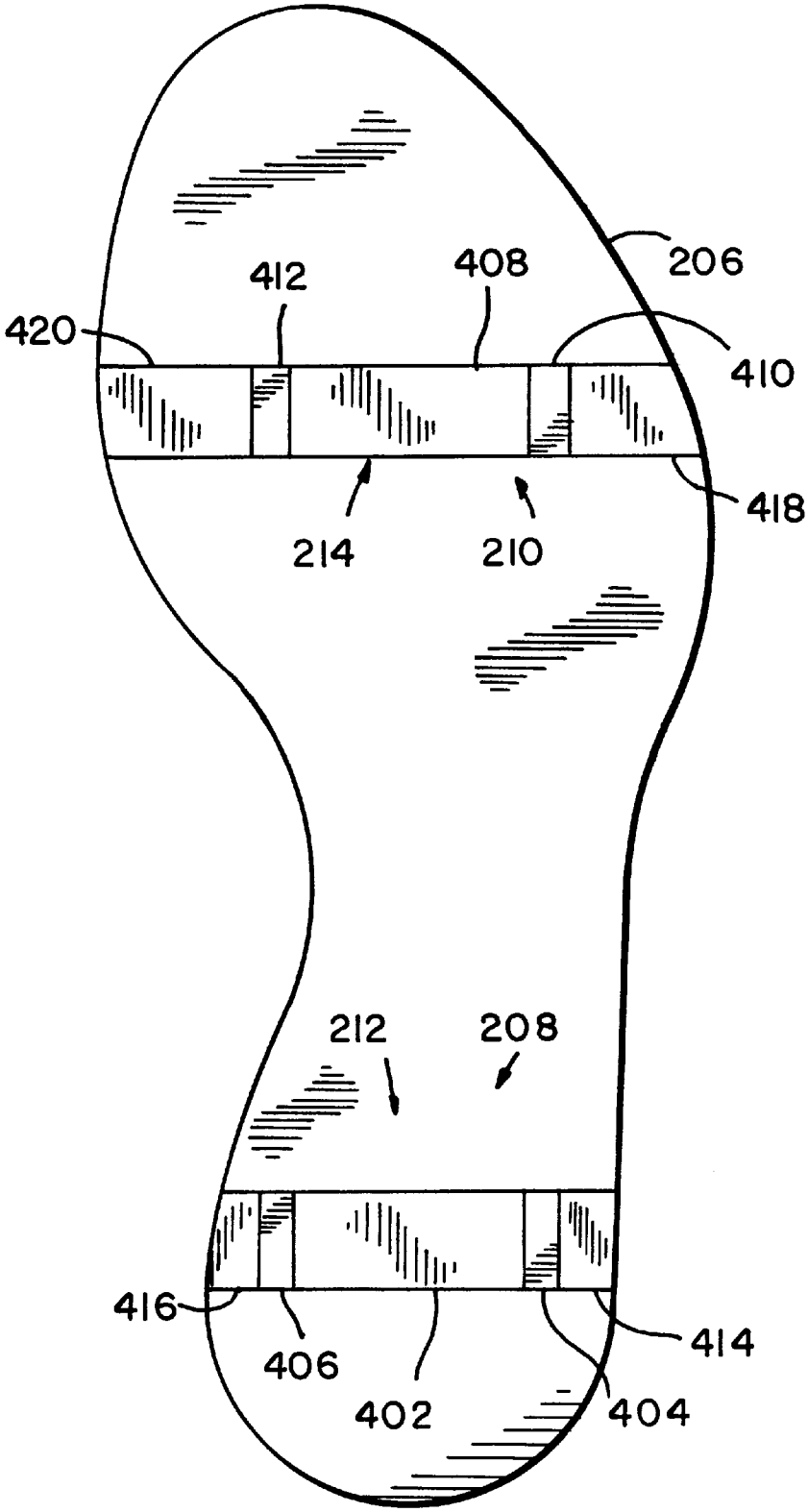
FIG. 4 is a cross-sectional bottom view of another running shoe constructed in accordance with the principles of the present invention.

As shown in FIG. 3, sensor 212 is preferably arranged with a piece of birefringent material 302 located between a LHCP 304 and a RHCP 306, and sensor 214 is preferably arranged with a piece of birefringent material 308 located between a LHCP 310 and a RHCP 312. Alternatively, as shown in FIG. 4, sensor 212 could be arranged with a piece of birefringent material 402 that is located between a LHCP 404 and a RHCP 406 that are each flanked by light transparent regions 414 and 416, and sensor 214 could be arranged with a piece of birefringent material 408 that is located between a LHCP 410 and a RHCP 412 that are each flanked by light transparent regions 418 and 420.

Light transparent regions 414, 416, 418, and 420 may be formed from any suitable light transparent material or combinations or materials, such as a gas filled (including normal air) cavity, an evacuated cavity, a clear piece of plastic, rubber, or gel, etc.

In operation, sensors 212 and 214 display a certain number of fringe bands and pass a certain color of light depending on the condition of sole 206 in shoe 200 and the wearer's body weight. When sole 206 is fairly new and providing good shock-absorbing capabilities, even though a wearer's foot is applying a portion of the wearer's body weight to sole 206, each piece of birefringent material 302, 308, 402, and 408 causes only a minimum amount of interference in the light entering that piece of birefringent material from any adjacent light polarizer 304, 306, 310, 312, 404, 406, 410, or 412. This is because only a minimal amount of force is being applied to the piece of birefringent material due to the new condition of the shock absorbing material. When this light then continues through that piece of birefringent material 302, 308, 402, or 408 and out of shoe 200 through the other light polarizer 304, 306, 310, 312, 404, 406, 410, or 412, the number of fringe bands displayed and the color of light passed correspond to sole 206 being in good condition for that wearer's body weight.

On the other hand, when sole 206 is fairly worn and providing poor shock-absorbing capabilities, applying the same portion of the wearer's body weight to sole 206 will cause each piece of birefringent material 302, 308, 402, and 408 to cause an excessive amount of interference in the light entering that piece of birefringent material from any adjacent light polarizer 304, 306, 310, 312, 404, 406, 410, or 412. This is because much more force is now being applied to the birefringent material due to the worn condition of the shock absorbing material. When this light then continues through that piece of birefringent material 302, 308, 402, or 408 and out of shoe 200 through the other light polarizer 304, 306, 310, 312, 404, 406, 410, or 412, the number of fringe bands displayed and the color of light passed correspond to sole 206 being in poor condition for that wearer's body weight.

Although two particular arrangements of birefringent materials, light polarizers, and light transparent regions are shown in FIGS. 3 and 4, sensors 212 and 214 could be configured with any suitable arrangement of birefringent materials, light polarizers, and light transparent regions (if desired) that allows light to pass from inside the birefringent materials to outside running shoe 200 where the light can be received by a viewer's eye. For example, only one end of sensor 212 or 214 could be exposed to light from an external surface of shoe 200 by placing a reflector at the other end of sensor 212 or 214. In this arrangement, light passes from outside shoe 200 into one end of the sensor, through the first light polarizer, through the birefringent material, through the second light polarizer, off the reflector at the other end of the sensor, back through the second light polarizer, back through the birefringent material, back through the first light polarizer, and into a viewer's eye. As another example, sensor 212 or 214 could be provided with a polarized light source or light source and a light polarizer. With this addition, light from the polarized light source or the light source and the light polarizer enters one end of the birefringent material, and then passes through the birefringent material, out the other end of the birefringent material, through a light polarizer, and into a viewer's eye. As yet another example, light could be channeled into the birefringent material from any external point on the shoe, or using any internal light source, through a suitable conduit.

Figure 5:
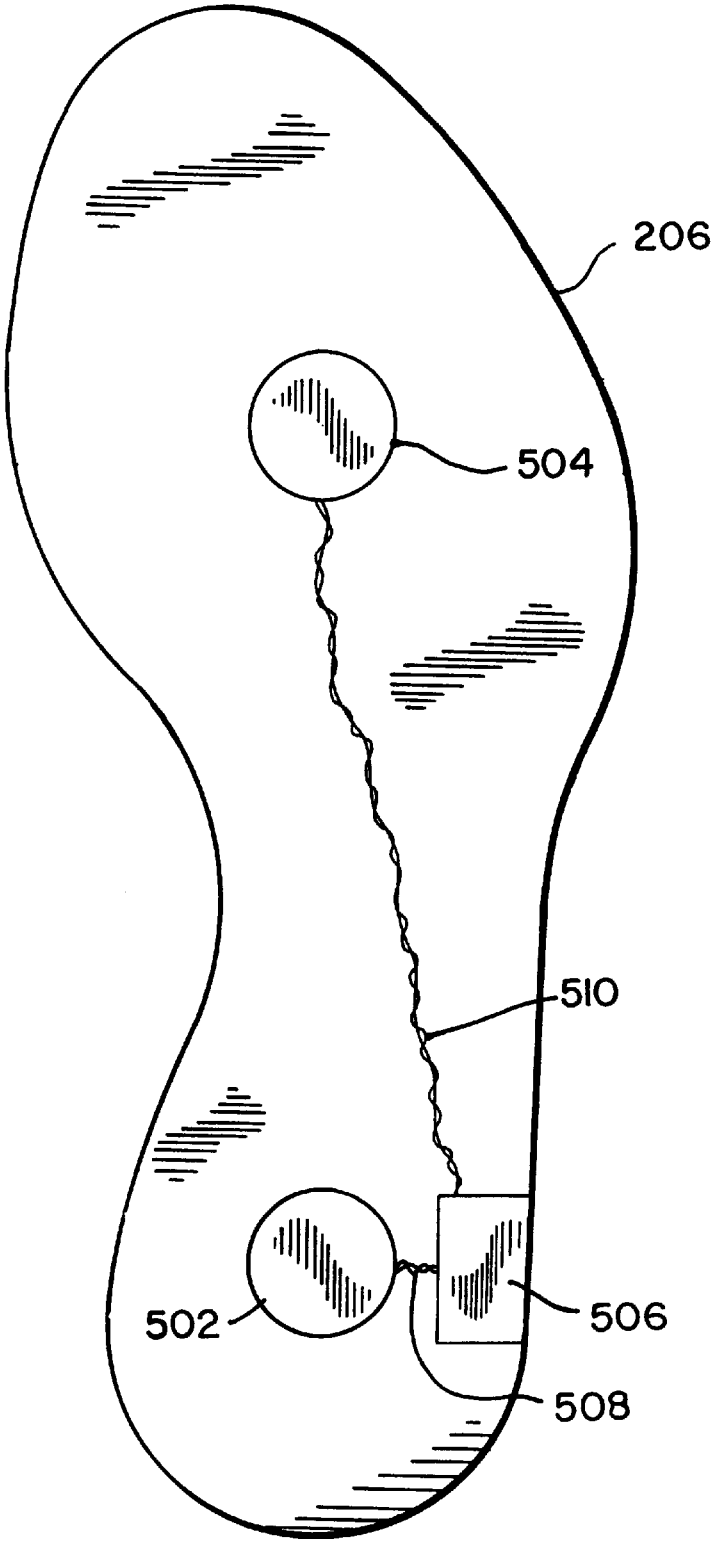
FIG. 5 is a cross-sectional bottom view of yet another running shoe constructed in accordance with the principles of the present invention.

An alternative embodiment of shoe sole 206 with a different type of sensor from that shown in FIGS. 2–4 is shown in FIG. 5. As illustrated, sole 206 includes sensors 502 and 504, circuit 506, and wires 508 and 510. Sensors 502 and 504 are pressure sensitive switches that close when a certain amount of pressure is applied to the sensors. Preferably, the pressure sensitivity of these switches is selectable through an adjustment either on the bottom of shoe 200 or from the inside of shoe 200. Alternatively, these switches may be preset to close at some amount of pressure that corresponds to sole 206 being worn out for the average weight user of shoe 200. Circuit 506 is a circuit that indicates to the wearer when sensors 502 and 504 have closed due to sensors 502 and 504 detecting that the shock-absorbing material in sole 506 has lost is shock-absorbing capability. Circuit 506 is connected to sensors 502 and 504 by wires 508 and 510, respectively.

Figure 6:
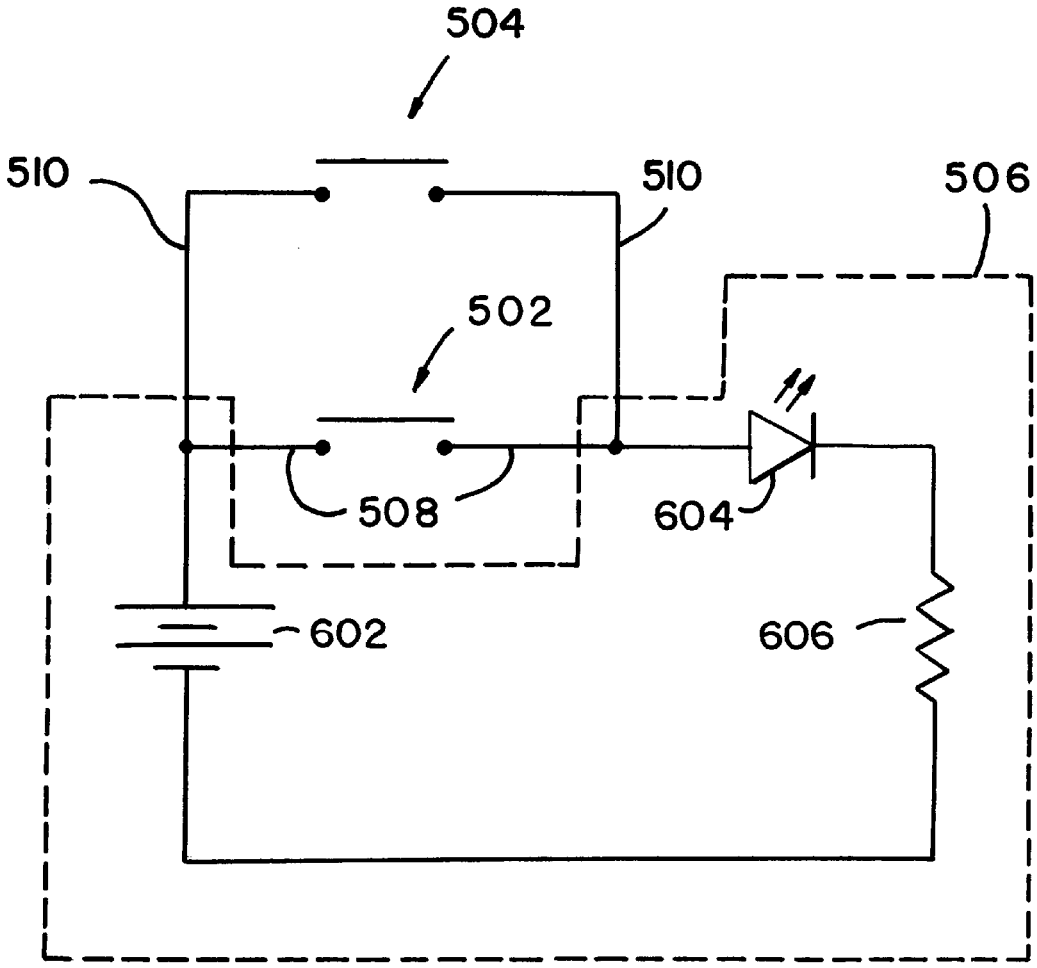
FIG. 6 is a schematic diagram of a circuit for indicating a loss of shock absorption in a shoe in accordance with the principles of the present invention.

Turning to FIG. 6, one embodiment of a circuit 506 is shown in detail. As illustrated, circuit 506 includes a battery 602, a light-emitting diode (LED) 604, and a resistor 606. Battery 602 is preferably a long-life lithium battery capable of driving LED 604, although any suitable battery or combination of batteries could be used. LED 604 and resistor 606 may be any standard LED and resistor known in the art. The positive terminal of battery 602 is connected to each of sensors 502 and 504 by wires 508 and 510. The other side of sensors 502 and 504 is connected to the anode of LED 604 by wires 508 and 510. The cathode of LED 604 is connected to one side of resistor 606, and the other side of resistor 606 is connected to the negative terminal of battery 602.

In operation, circuit 506 operates in combination with sensors 502 and 504 as follows. When either of sensors 502 or 504 close due to the shock-absorbing material in shoe sole 206 (FIG. 2 and 5) having worn out, current from battery 602 flows through the closed sensor 502 or 504. This current then flows from that sensor 502 or 504 through LED 604, causing it to illuminate. Finally, the current passes through resistor 606 and completes the circuit upon entering the negative terminal of battery 602.

Although particular embodiments of sensors 502 and 504 and circuit 506 are shown in and discussed in connection with FIGS. 5 and 6, any suitable sensors and circuit, or combination of sensors and circuits, may be used in accordance with the present invention to indicate to a wearer of shoe 200 the shock-absorbing material in sole 206 has worn out. For example, sensors 502 and 504 could incorporate strain gauges capable of measuring the pressure on sensors 502 and 504 as shoe sole 206 wears out. In this example, circuit 506 could then incorporate an error amplifier that converts the measurement made by the strain gauges in sensors 502 and 504 into a signal that is then compared by a comparator to some reference voltage. When the signal from the error amplifier exceeds the reference voltage, an LED in circuit 506 would then be illuminated by the comparator to indicate to the wearer of shoe 200 that sole 206 has become worn out. As another example, circuit 506 could incorporate filter circuitry to ignore brief indications that sensors 502 and 504 are being subjected to excessive forces to prevent brief impact forces, such as those that occur from walking, running, and jumping, from appearing as indications that shoe sole 206 is worn out.

Figure 7:
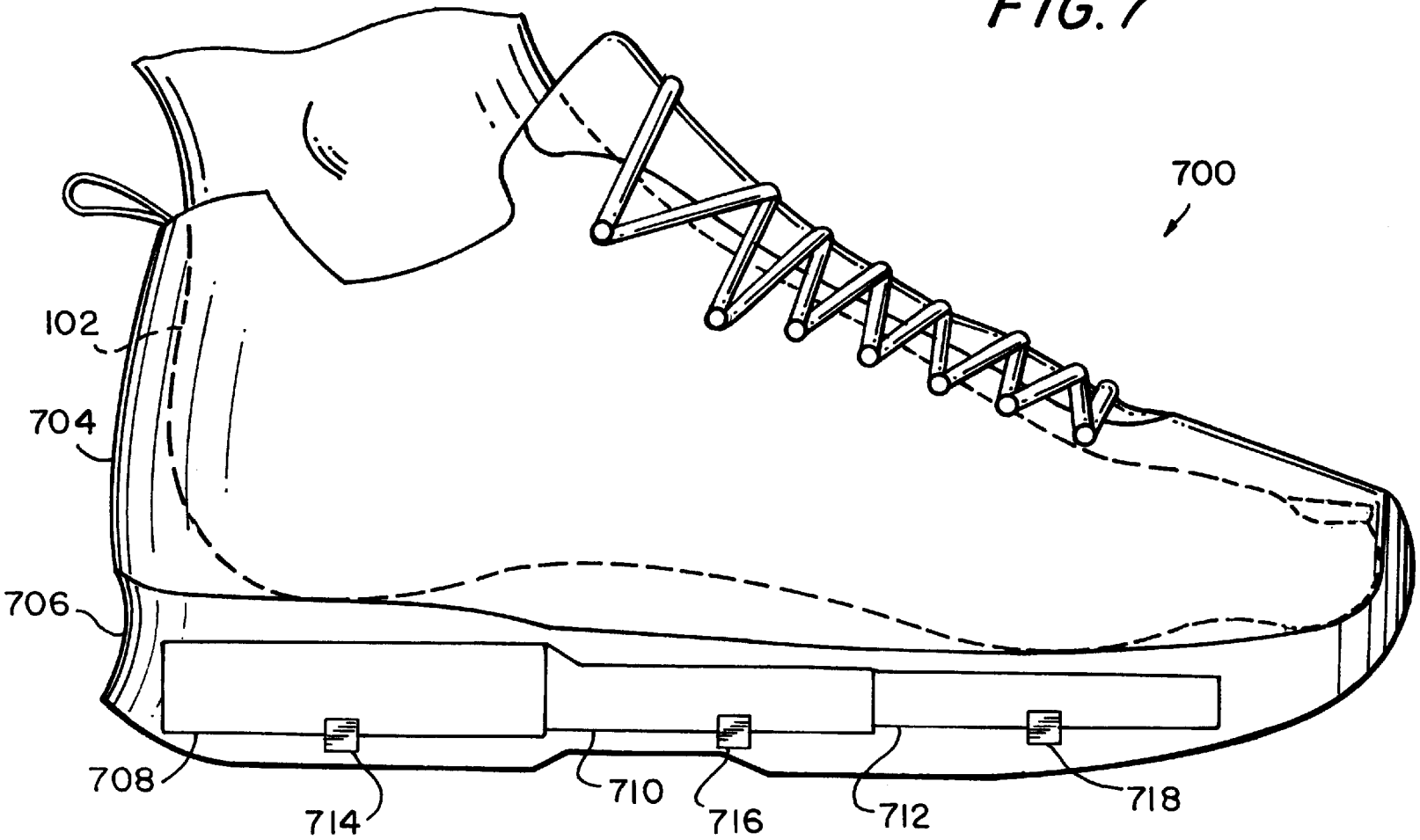
FIG. 7 is a cross-sectional side view of another running shoe constructed in accordance with the principles of the present invention.

Turning to FIG. 7, another shoe 700 in accordance with the present invention is shown. As illustrated, shoe 700 incorporates an upper portion 704 and a sole 706. Upper portion 704 is substantially the same as upper portions 104 and 204 as shown in FIGS. 1 and 2, respectively. Sole 706, however, differs from soles 106 and 206, in the regard that it includes pieces of removable absorbing material 708, 710, and 712. Like sole 206, sole 706 also contains multiple sensors 714, 716, and 718 adjacent to pieces of removable absorbing material 708, 710, and 712, respectively. Each sensor 714, 716, and 718 is substantially the same as sensors 212 and 214, although each could be implemented using sensors like sensors 502 and 504, or like any other suitable sensor or combination of sensors.

In sole 706, each piece of removable absorbing material 708, 710, and 712 maybe removed from sole 706 when the absorbing material has worn out or the wearer has decided to change the absorbing material for any other purpose, such as to select a softer or firmer type of material. As with shoe 200, a viewer can tell when each piece of removable absorbing material 708, 710, and 712 has worn out by observing the adjacent sensor 714, 716, or 718. Replacement of the pieces of removable absorbing material 708, 710, and 712 may be accomplished by sliding the pieces out the side of sole 706, by sliding the pieces out the back of sole 706, by lifting the pieces out of sole 706 from inside shoe 700, or by any other suitable method or combination of methods. When replacing each piece of removable absorbing material 708, 710, and 712, the adjacent sensor 714, 716, and 718, respectively could also be removed with the absorbing material or left intact in shoe 700.

Although a particular size and number of pieces of removeable absorbing material 708, 710, and 712 are shown in FIG. 7, any number of pieces of absorbing material could be use in accordance with the present invention. Also, each piece of absorbing material 708, 710, and 712 could be made from any suitable material, such as ethylene vinyl acetate (EVA) or polyurethane.

In order to make the force or stress upon each sensor 212, 214, 502, 504, 714, 716 and 718 more pronounced with the wear of the shock absorbing material around that sensor, a small air gap or region of material that is softer than the shock absorbing material could be located directly above the sensor. In this arrangement, when the shoe containing the sensor is new, almost no force or stress would be placed upon the sensor. When the shock absorbing material starts to wear, however, the gap would close or the region of soft material would compress, and force or stress would then increase upon the sensor.

Although two sets of sensors are shown in specific positions in each of the embodiments of shoe 200 shown in FIGS. 2–6, and three sets of sensors are shown in specific positions of the embodiment of shoe 700 shown in FIG. 7, any number of sensors in any locations in shoe soles 206 and 706 could be used in accordance with the present invention. For example, sensors 214, 504, 716, and 718 in FIGS. 2–7 could be omitted in accordance with the present invention. As another example, sensors 212, 502, and 714 in FIGS. 2–7 could be omitted in accordance with the present invention. As yet another example, one or more additional sensors could be used in addition to sensors 212 and 214 in FIGS. 2–4, sensors 502 and 504 in FIG. 5, and sensors 714, 716, and 718 in FIG. 7. As still another example, sensors 212, 214, 502, 504, 714, 716, and 718 in FIGS. 2–7 could be located in any vertical position between a wearer's foot 102 and the ground.

Also, although specific types of sensors 212, 214, 502, 504, 714, 716, and 718 are shown in FIGS. 2–7, any other suitable sensor for detecting pressure and indicating an excessive level of pressure can be used in shoes 200 and 700 in accordance with the present invention. For example, a spring-based gauge could be used so that as the shock-absorbing material in sole 206 or 706 wears out, more pressure is transferred to the spring-based gauge, causing the gauge to indicate the level of wear in sole 206 or 706. As another example, a differential sensor could be placed in sole 206 or 706 that measures the relative amount of the load born by the shock-absorbing material as compared with the total load born by the shoe or a portion of the shoe. In this example, when the portion of the load born by the shock-absorbing material drops below a predetermined percentage of the load, the sensor could indicate that sole 206 or 706 is worn out. Such a differential-sensor embodiment could be implemented using electrical or mechanical devices, or using any other suitable technology.

Moreover, although the present invention is illustrated in FIGS. 1–7 in connection with a running shoe, the present invention is equally applicable to any type of shoe that provides shock absorption. For example, the present invention may also be implemented in basketball shoes, tennis shoes, walking shoes, hiking shoes, certain dress shoes, etc.

Persons skilled in the art will appreciate that the principles of the present invention can be practiced by other than the described embodiments, which are presented for purposes of illustration and not of limitation, and the present invention is limited only by the claims which follow.

What is claimed is:

1. A device that indicates wear in a shock-absorbing material of a shoe sole when a load is placed on said shoe sole, comprising:

a sensor positioned in said shoe sole so that when said shock-absorbing material becomes less resilient, an increased percentage of said load is placed on said sensor, wherein said sensor provides an indication that said shock-absorbing material is worn out when a certain amount of said load is placed on said sensor.

2. The device of claim 1, wherein said sensor comprises:

a birefringent material; and a light polarizer positioned so that light from inside said birefringent material can pass through said light polarizer to an area outside said shoe sole.

3. The device of claim 2, wherein said birefringent material is a transparent polyurethane rubber called "PSM9."

4. The device of claim 2, wherein said sensor further comprises a second light polarizer positioned so that light from an area outside said shoe sole can pass through said second light polarizer into said birefringent material.

5. The device of claim 1, wherein said sensor comprises a pressure sensitive switch that closes when said certain amount of said load is placed on said sensor, and wherein said shoe sole further comprises a circuit that indicates when said pressure sensitive switch is closed.

6. A device that indicates wear in a shock-absorbing material of a shoe sole when a load is placed on said shoe sole, comprising:

a birefringent material positioned within said shoe sole so that as said shock-absorbing material becomes less elastic, said birefringent material bears an increased percentage of said load born by said shoe sole and produces interference in light in said birefringent material that is indicative of wear in said shock-absorbing material; and a light polarizer positioned within said shoe sole so that said light polarizer permits light from inside said birefringent material to pass through said light polarizer to an area outside said shoe sole.

7. A device that indicates wear in a shock-absorbing material of a shoe sole when a load is placed on said shoe sole, comprising:

a light polarizer; and a birefringent material, wherein said light polarizer and said birefringent material are positioned within said shoe sole so that as said shock-absorbing material in said shoe sole becomes less elastic, said birefringent material bears an increased percentage of said load born by said shoe sole and produces interference in light in said birefringent material that is indicative of wear in said shock-absorbing material, and so that said light polarizer is substantially adjacent to said birefringent material and permits light from inside said birefringent material to pass through said light polarizer to an area outside said shoe sole.

8. A method for indicating wear in a shock-absorbing material of a shoe sole when a load is placed on said shoe sole, comprising:

positioning a sensor in said shoe sole so that when said shock-absorbing material becomes less resilient, an increased percentage of said load is placed on said sensor; and providing an indication that said shock-absorbing material is worn out when a certain amount of said load is placed on said sensor.

9. The method of claim 8, further comprising:

using a birefringent material and a light polarizer as part of said sensor; and positioning said birefringent material and said light polarizer so that light from inside said birefringent material can pass through said light polarizer to an area outside said shoe sole.

10. The method of claim 9, further comprising positioning a second light polarizer so that light from an area outside said shoe sole can pass through said second light polarizer into said birefringent material.

11. The method of claim 8, further comprising:

using, as part of said sensor, a pressure sensitive switch that switches when said certain amount of said load is placed on said sensor; and indicating when said pressure sensitive switch has switched.

12. A method for indicating wear in a shock-absorbing material of a shoe sole when a load is placed on said shoe sole, comprising:

positioning a birefringent material within said shoe sole so that as said shock-absorbing material becomes less elastic, said birefringent material bears an increased percentage of said load born by said shoe sole and produces interference in light in said birefringent material that is indicative of wear in said shock-absorbing material; and positioning a light polarizer within said shoe sole so that said light polarizer permits light from inside said birefringent material to pass through said light polarizer to an area outside said shoe sole.

13. A shoe sole that is subject to a load from a wearer, comprising:

a piece of removable absorbing material positioned within said shoe sole; and a sensor positioned within said shoe sole so that when said piece of removable absorbing material becomes less resilient, an increased percentage of said load is placed on said sensor, wherein said sensor provides an indication that said shock-absorbing material is worn out when a certain amount of said load is placed on said sensor.

* * * * *